US008157057B1

(12) United States Patent
Johnson

(10) Patent No.: US 8,157,057 B1
(45) Date of Patent: Apr. 17, 2012

(54) SAFETY APPARATUS FOR SCAFFOLDING

(76) Inventor: Kenneth Johnson, Spring Hill, FL (US)

( * ) Notice: Subject to any disclaimer, the term of this patent is extended or adjusted under 35 U.S.C. 154(b) by 1068 days.

(21) Appl. No.: 12/075,865

(22) Filed: Mar. 14, 2008

Related U.S. Application Data

(60) Provisional application No. 60/918,598, filed on Mar. 16, 2007.

(51) Int. Cl.
*E04G 7/02* (2006.01)

(52) U.S. Cl. ..... 182/112; 182/3; 182/36; 182/113; 256/59; 256/67

(58) Field of Classification Search ..... 182/3, 36, 182/112, 113; 256/59, 65.02, 67, DIG. 6
See application file for complete search history.

(56) References Cited

U.S. PATENT DOCUMENTS

| | | | | |
|---|---|---|---|---|
| 4,171,033 | A | 10/1979 | Rust et al. | |
| 4,257,491 | A | 3/1981 | Presnall, Jr. et al. | |
| 4,391,348 | A | 7/1983 | Rieland | |
| 4,984,654 | A | 1/1991 | Anderson | |
| 5,219,039 | A | 6/1993 | Bell | |
| 5,316,102 | A | 5/1994 | Bell | |
| 5,358,068 | A * | 10/1994 | Whitmer | 182/113 |
| 5,361,866 | A | 11/1994 | Bell et al. | |
| 5,979,599 | A | 11/1999 | Noles | |
| 6,053,281 | A * | 4/2000 | Murray | 182/113 |
| 6,321,872 | B1 | 11/2001 | Parker | |
| 6,378,651 | B1 | 4/2002 | Ecker et al. | |
| 6,412,230 | B1 * | 7/2002 | Zambelli et al. | 52/27 |
| 6,412,598 | B1 * | 7/2002 | Mackinnon | 182/3 |
| 6,502,663 | B2 * | 1/2003 | Ecker et al. | 182/3 |
| 6,520,290 | B1 | 2/2003 | Carter | |
| 6,679,480 | B1 * | 1/2004 | Hara et al. | 256/47 |
| 6,776,259 | B1 * | 8/2004 | Murten | 182/3 |
| 6,779,630 | B2 | 8/2004 | Choate | |
| 6,805,220 | B2 * | 10/2004 | Fulton et al. | 182/3 |
| 7,048,090 | B2 * | 5/2006 | Dean et al. | 182/3 |
| 7,637,351 | B2 * | 12/2009 | Langsmead | 182/113 |
| 2001/0032435 | A1 | 10/2001 | Austin | |
| 2002/0185335 | A1 | 12/2002 | Verdyk | |
| 2002/0189898 | A1 | 12/2002 | Campbell | |
| 2003/0047382 | A1 * | 3/2003 | Panacci | 182/113 |
| 2005/0189171 | A1 | 9/2005 | Bos | |
| 2006/0140718 | A1 * | 6/2006 | Lamore | 404/6 |
| 2006/0272891 | A1 * | 12/2006 | Casebolt | 182/36 |

* cited by examiner

*Primary Examiner* — Alvin Chin Shue
*Assistant Examiner* — Colleen M Chavchavadze
(74) *Attorney, Agent, or Firm* — Emery L. Tracy

(57) ABSTRACT

A safety apparatus for releasably securing persons wearing a body harness to scaffolding is provided. The scaffolding has a plurality of horizontal and vertical bars. The safety apparatus comprises a front frame assembly releasably securable between a first two adjacent bars of the scaffolding. A rear frame assembly is releasably securable between a second two adjacent bars of the scaffolding with the rear frame assembly spaced from the front frame assembly. A cable is retractably connected between the front frame assembly and the rear frame assembly with the body harness releasably connectable to the cable.

16 Claims, 4 Drawing Sheets

SAFETY APPARATUS FOR SCAFFOLDING

The present application claims benefit of priority of pending provisional patent application Ser. No. 60/918,598, filed on Mar. 16, 2007, entitled "Safety Apparatus for Scaffolding".

BACKGROUND OF THE INVENTION

1. Field of the Invention

This invention relates generally to a safety apparatus for scaffolding and, more particularly, the invention relates to significantly reducing the number of severe or fatal injuries that occur in the scaffold industry.

2. Description of the Prior Art

The dubious distinction of being the most dangerous job belongs to construction workers who have the highest fatality rate of any profession. Falls continue to be the number one cause of disabling injuries to construction workers and fifty percent of workers who fall eleven (11) feet or more to a hard surface are killed. Although falling from a roof or ladder accounts for many of these accidents, falling from a scaffold accounts for a significant number of injuries and a disproportionate number of the deaths. Approximately 2.3 million construction workers work frequently from scaffolds. In a recent study, seventy-two (72%) percent of workers injured in scaffolding accidents attributed the fall to the support or planking giving way or to the employee slipping or being struck by a falling object from above.

There are many different types of scaffolds, each with different risk factors. The most commonly used scaffolds in the commercial construction industry are referred to as sectional frames, mason, walkthrough, ladder, and shoring. Other scaffolds include modular scaffolding such as Systems, QES, etc., and tubes and clamp. The risk of falling from any type of scaffold remains the same, however, regardless of what type of scaffold is used and it's not just falls from pulse-quickening heights that are the problem. Workers are injured in falls from all manners of elevated surfaces and various heights including, but not limited to wind, ice, dead ends (where the plank is not in full contact with the next frame, fear (common with new employees), and lack of awareness.

For more than ten years, OSHA, insurance industry, and safety inspectors have forced scaffold workers to wear body harnesses with lanyards. Failure to wear the proper equipment increased the risk of being fired. To this day, it is not possible, however, for workers to tie off while erecting or dismantling scaffolding.

The present invention is designed to bring safety to higher levels with speed, efficiency, and adjustability without the fear of falling or tripping in one simple portable package which is lightweight, easy to set up, and use.

SUMMARY

The present invention is a safety apparatus for releasably securing persons wearing a body harness to scaffolding. The scaffolding has a plurality of horizontal and vertical bars. The safety apparatus comprises a front frame assembly releasably securable between a first two adjacent bars of the scaffolding. A rear frame assembly is releasably securable between a second two adjacent bars of the scaffolding with the rear frame assembly spaced from the front frame assembly. A cable is retractably connected between the front frame assembly and the rear frame assembly with the body harness releasably connectable to the cable.

In addition, the present invention includes a method for releasably securing persons wearing a body harness to scaffolding. The scaffolding has a plurality of horizontal and vertical bars. The method comprises releasably securing a front frame assembly between a first two adjacent bars of the scaffolding, releasably securing a rear frame assembly between a second two adjacent bars of the scaffolding, spacing the rear frame assembly from the front frame assembly, retractably connecting a cable retractably between the front frame assembly and the rear frame assembly, releasably securing a cable diverter between the front frame assembly and the rear frame assembly, and releasably connecting the body harness to the cable.

DETAILED DESCRIPTION OF THE PREFERRED EMBODIMENTS

Figure 1:
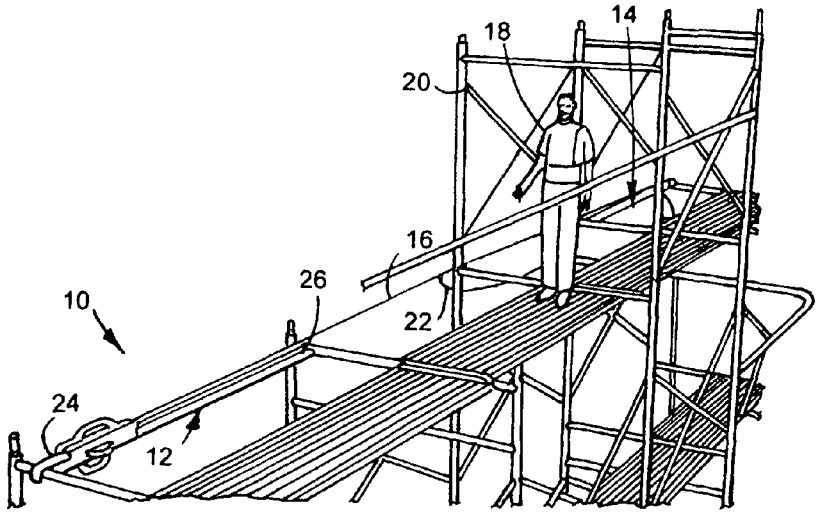
FIG. 1 is a perspective view illustrating a safety apparatus for scaffolding, constructed in accordance with the present invention.

As illustrated in FIGS. 1-8, the present invention is a safety apparatus, indicated generally at 10, for scaffolding. The safety apparatus 10 of the present invention significantly reduces the risk of severe or fatal injuries that occur from workers falling from scaffolding.

The safety apparatus 10 of the present invention has a front frame assembly 12 and a rear frame assembly 14 with a cable 16 retractably connected therebetween and is used in conjunction with a body harness 18 and scaffolding 20. The scaffolding 20 is comprised of a plurality of horizontal and vertical bars or pipes. In particular, the safety apparatus 10 is comprised of anchoring and connection devices and can be used as a personal fall restraint device when working on a scaffold. The connection to the body harness 18 is accomplished by use of a lanyard 22 connectable to the cable 16 between the front frame assembly 12 and the rear frame assembly 14.

The front frame assembly 12 has a first end 24 and a second end 26 with a cable suspension section 28 at the first end 24 and a clamp assembly 30 at the second end 26. A first elongated tube 32 extends from the first end 24 and a second elongated tube 34 extends from the second 26 end with the first elongated tube 32 receivable within the second elongated tube 34 allowing the length of the front frame assembly 12 to be adjusted, as desired. Aligned apertures 36 in the first elongated tube 32 and the second elongated tube 34 receive pins 38 releasably securable within the aligned apertures 36.

The rear frame assembly 14, like the front frame assembly 12, has a first end 40 and a second end 42 with a cable section 44 at the first end 40 and a clamp assembly 46 at the second end 42. A first elongated tube 48 extends from the first end 40 and a second elongated tube 50 extends from the second end 42 with the first elongated tube 48 receivable within the second elongated tube 50 allowing the length of the rear frame assembly 14 to be adjusted. Aligned apertures 52 in the first elongated tube 48 and the second elongated tube 50 receive pins 54 releasably securable within the aligned apertures 52.

Positioned at the first ends 24, 40 and the second ends 36, 42 of the front frame assembly 12 and the second frame assembly 14, respectively is a clamping mechanism 56 having a hook end positionable about the scaffolding. Preferably, each of the hook ends has rubber inserts 63 to prevent slippage when used in a horizontal (sideways) position, for bracket use (see FIG. 8). In full grip mode, the hook ends preferably cover eighty (80%) percent to ninety (90%) percent of the scaffolding pipe size. A tightening system 58 releasably secures each of the hook ends and, thus, the front frame assembly 12 and the rear frame assembly 14, to the scaffolding 20. Preferably, the tightening system 58 is a single rubber-encased ball joint off extension connected to a hardened stainless steel threaded shaft coarse thread (for speed) that mount on the adjusting head that slides onto the body. For ease of use, there is an opening in the body so the flex shaft can swing left to right to either side and can be easily reached from top or bottom for tightening and loosening of the tightening system 58.

Figure 7:
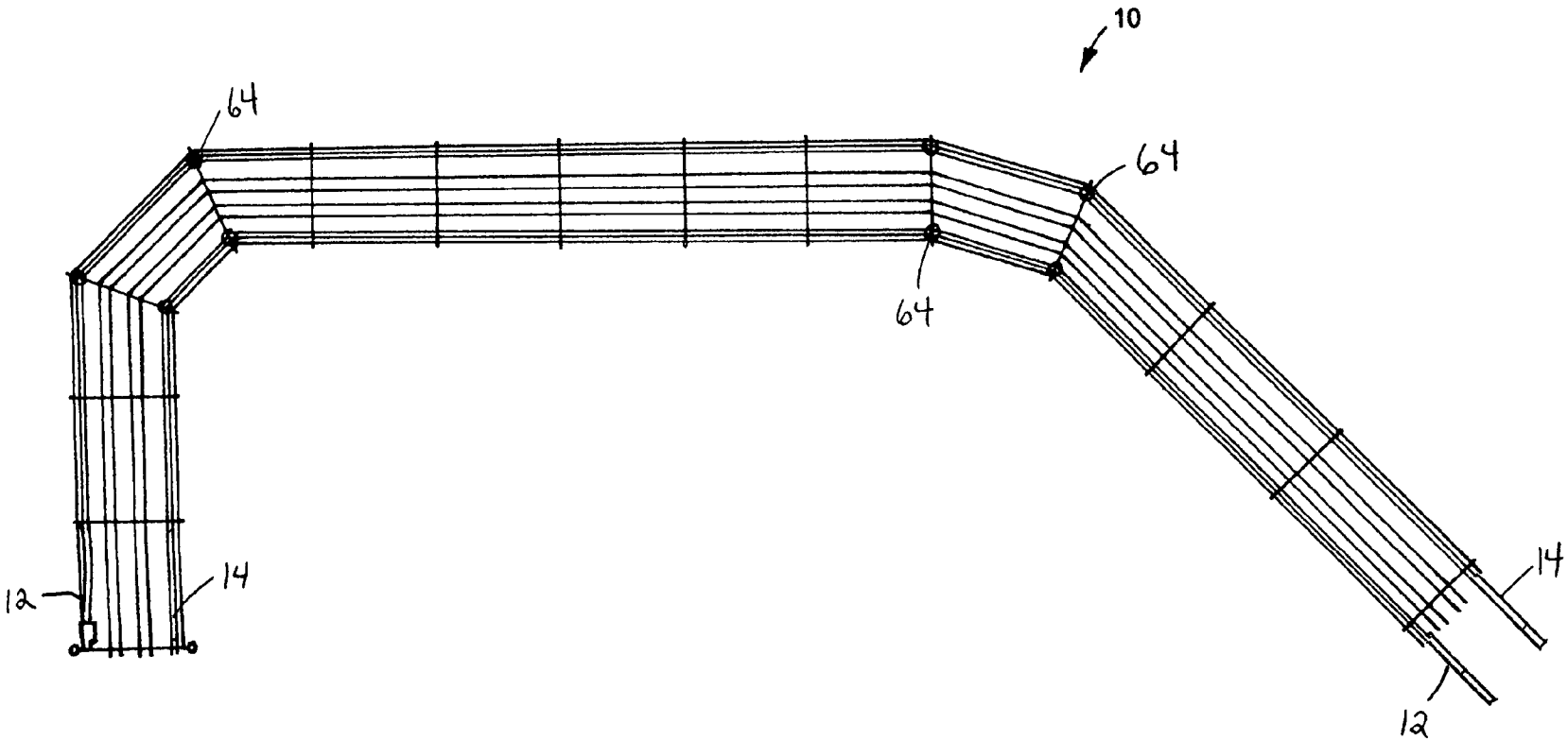
FIGS. 7 and 8 are additional views to assist in the understanding of the present invention.
Figure 8:
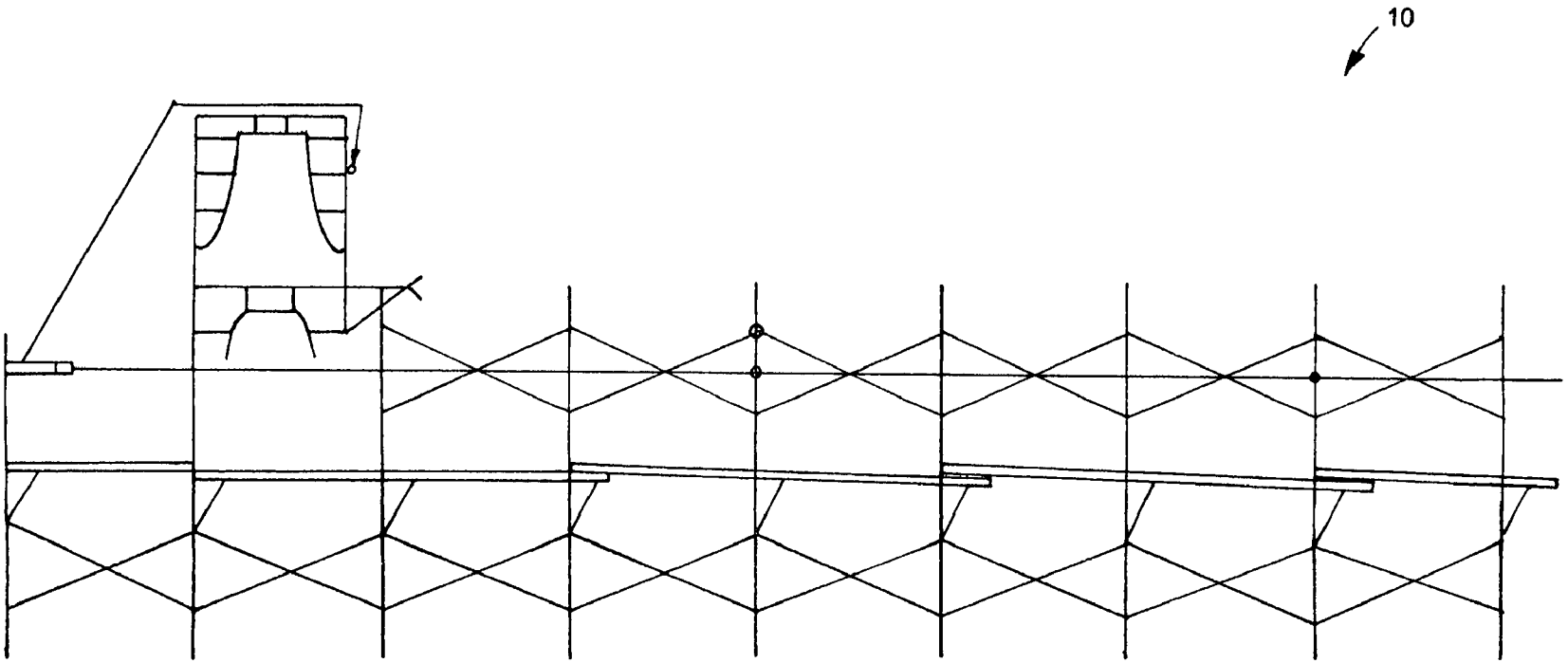

Both the front frame assembly 12 and the rear frame assembly 14 can be quickly tightened or loosened about the scaffolding 20 and shifted up or down by one man. As described, both front and rear main frame assemblies 12, 14 are equipped with an elongated opening for shifting purposes, otherwise a sliding effect for the ease of shifting and placement. The safety apparatus 10 can be adjusted, or rigged, allowing a worker to move safely within, outside (bracket use), above, or below an elevated work area. Plus, the cable 16 is positioned only approximately one (1") inch away from the frame and very close to the sides away from the walking area making for a reduced trip hazard. Both frame assemblies 12, 14 also employ lift handles 60 above and below for ease of placement for vertically challenged or shorter workers. Two complete units allow workers to pass each other while working with no fear of crossing cables (as illustrated in FIG. 7).

Figure 3:
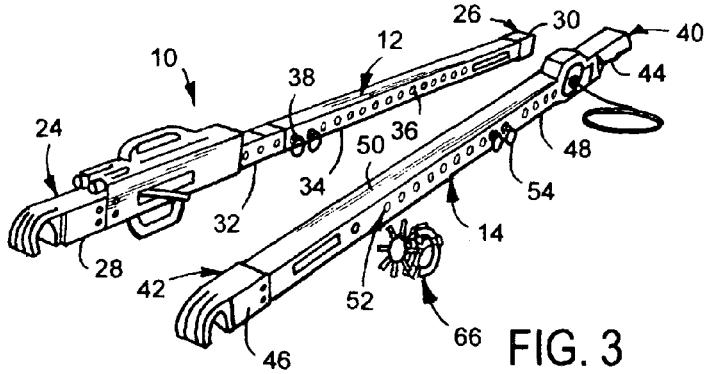
FIG. 3 is a perspective view illustrating a cable suspension section and a clamp assembly of the safety apparatus for scaffolding, constructed in accordance with the present invention.

As illustrated in FIG. 3, the front and rear frame assemblies 12, 14 can be purchased separately in random lengths of preferably three (3') feet to eight (8') feet lengths. In addition, the adjustment bars can be cut to length. The bars are preferably square or rectangular and constructed from a heavy gauge reinforced nylon per engineering requirements. The aligned adjustment holes are spaced approximately every one (1') foot on center per specifications. The attachment ends are specifically drilled as the receiving ends.

Figure 4:
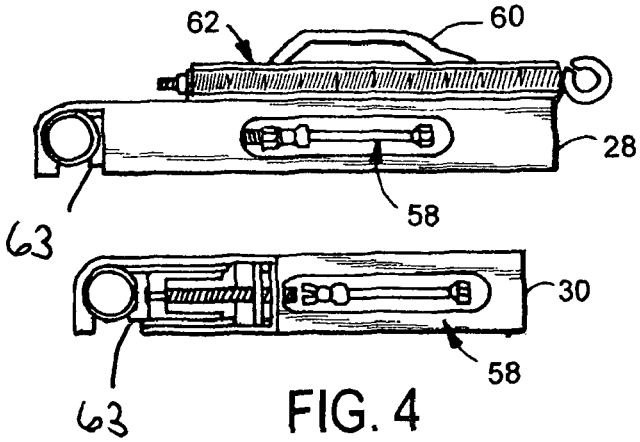
FIG. 4 is a sectional view illustrating the cable suspension section and the clamp assembly of the safety apparatus for scaffolding, constructed in accordance with the present invention.

As illustrated in FIG. 4, a tensioning device 62 is mounted to the front frame assembly 12 and is preferably a twin tube design module. The tensioning device 62 is preferably approximately two (2') feet long and about two (2") to three (3") inches wide. The tensioning device 62 has a nylon housing ribbed for strength and a slot with a clear replaceable cover 65 for visual setting of the pre-load tension. Inside the nylon tube is a hardened stainless steel reinforcement tube that houses a semi-threaded steel shaft. The threaded shaft is encompassed by a number of tensile springs which vary in the amount of tension afforded.

The springs are positioned along the length of the shaft in a sequential manner defined by the tensile strength of each spring, the spring with the highest tensile strength being positioned adjacent to the attachment eyelet, the spring with the least amount of tensile strength being positioned at the opposite end. The threaded end is secured by the use of thrust washers and locknuts. The shafts are of a single or two piece design that attach to a swivel eyelet so the cable can spin out.

Figure 2:
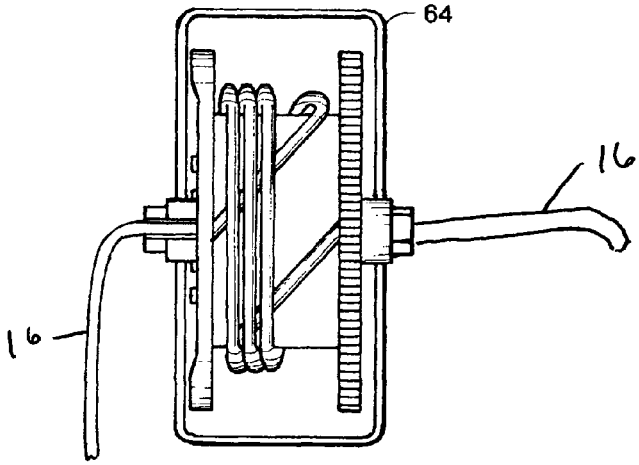
FIG. 2 is a sectional view illustrating a gear housing of the safety apparatus for scaffolding, constructed in accordance with the present invention.
Figure 5:
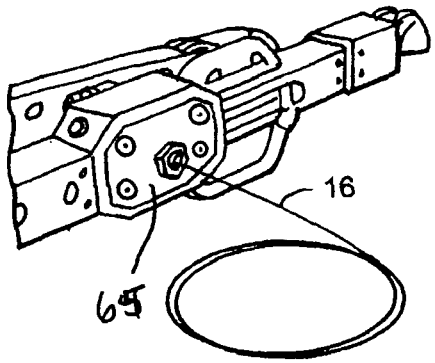
FIG. 5 is a perspective view illustrating the excess cable exiting out of the side of the gear/cable drum/spool assembly of the safety apparatus for scaffolding, constructed in accordance with the present invention.

As illustrated in FIGS. 2 and 5, a cable case 64 is secured to the rear frame assembly 14. The cable case 64 is preferably a two piece design with opposite interlocking sides. All bearings are locked inside the protective housing. The cable 16, drum, spindle, etc., are accessible by lifting the top hinged locking cover. Also, the cable case 64 includes a clear plastic replaceable cable viewing window (to insure cable 16 has not unwound and spooled incorrectly). The cable case 64 preferably has a width of approximately four (4") inches. Extruding shafts can be a little wider. The drum preferably has a diameter of approximately seven (7") inches to approximately eight (8") inches.

The cable/winch system has a main part or the drum spindle assembly consisting of two aluminum (aircraft grade) gears with pressed and keyed nylon teeth. The main cable spindle also has holes drilled into the center and out the ends so the cable 16 can actually enter the spindle and exit out either side of the spindle which is the main reason to get rid of excess cable that would normally be spooled on the drum. The most cable 16 the spool would have to hold is no more than ten (10') feet of 3/16" to 1/4" aircraft grade cable.

All extra cable can be pulled out the side and coiled and tied to the frame. There is also a high tension plate (spring loaded) to prevent spooled cable from unwinding on the drum with no more than ten (10') feet of cable having to be pulled out at any time. The housing also has a cable stop on both sides of the exit to keep tension on the cable during transfer point when dogs are set to "on". Also, each side of the spindle end has a 7/8 HEX to allow cranking from either side top or bottom.

Figure 6:
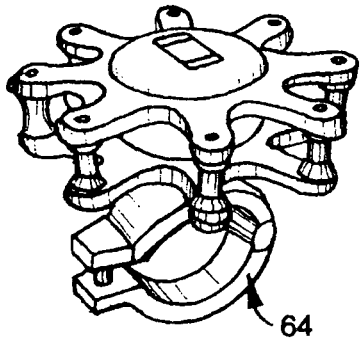
FIG. 6 is a perspective view illustrating a cable diverter mechanism of the safety apparatus for scaffolding, constructed in accordance with the present invention.

As illustrated in FIG. 6, the present invention includes cable diverters 66 releasably securable to the scaffolding 20 between the front frame assembly 12 and the rear frame assembly 14. Preferably, the cable diverters 66 are of a turnstile design with free floating cable guides mounted around needle bearings allowing cable grabs to pass by without hanging up. The cable diverters 66 allow the cable 16 to angle around with the scaffolding 20, without interfering with plank or workers. On side mounted use in case a worker falls, (bracket use), the cable diverters 66 keep the cable 16 in a straight line pull. Also, in an embodiment of the present invention, the cable diverters 66 have built in levels on top for accuracy.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A safety apparatus for releasably securing persons wearing a body harness to scaffolding, the scaffolding having a plurality of horizontal and vertical bars, the safety apparatus comprising:

a front frame assembly releasably securable between a first two adjacent bars of the scaffolding, the front frame assembly having a first end and a second end with a cable suspension section at the first end and a clamp assembly at the second end;

a rear frame assembly releasably securable between a second two adjacent bars of the scaffolding, the rear frame assembly spaced from the front frame assembly;

a cable retractably connected between the front frame assembly and the rear frame assembly, the body harness releasably connectable to the cable;

a first elongated tube extending from the first end of the front frame assembly;

a second elongated tube extending from the second end of the front frame assembly with the first elongated tube receivable within the second elongated tube;

a plurality of aligned apertures in the first elongated tube and the second elongated tube; and at least one pin releasably securable within the aligned apertures.

2. The safety apparatus of claim 1 wherein the rear frame assembly has a first end and a second end with a cable suspension section at the first end and a clamp assembly at the second end.

3. The safety apparatus of claim 2 and further comprising:

a first elongated tube extending from the first end of the rear frame assembly;

a second elongated tube extending from the second end of the rear frame assembly with the first elongated tube receivable within the second elongated tube;

a plurality of aligned apertures in the first elongated tube and the second elongated tube; and at least one pin releasably securable within the aligned apertures.

4. The safety apparatus of claim 1 and further comprising:

a hook end at the first ends and second ends of the front frame assembly and the frame assembly for releasably securing the front frame assembly and the frame assembly to the bars of the scaffolding, the hook end positionable about the scaffolding.

5. The safety apparatus of claim 4 wherein each of the hook ends have rubber inserts.

6. The safety apparatus of claim 1 and further comprising:

a single rubber-encased extension connected to a hardened stainless steel coarse threaded shaft in an opening and coupled to a flex shaft.

7. The safety apparatus of claim 1 and further comprising:

a cable tensioning device at the first end of the front frame assembly;

wherein the cable tensioning device has a housing and a slot with a clear replaceable cover;

wherein the housing is a hardened stainless steel reinforcement tube housing a semi-threaded steel shaft; and wherein the threaded shaft is encompassed by a number of tensile springs varying in the amount of tension.

8. The safety apparatus of claim 7 wherein the springs are positioned along the length of the shaft in a sequential manner defined by the tensile strength of each spring, the spring with the highest tensile strength being positioned adjacent to an attachment eyelet, the spring with the least amount of tensile strength being positioned at the opposite end.

9. The safety apparatus of claim 1 and further comprising:

a cable case secured to the rear frame assembly;

wherein the cable case is a two piece design, said cable case comprising bearings, all bearings being positioned inside the protective housing; and wherein the cable case has apertures for receiving the cable and allowing the cable to spindle into and exit out either side.

10. The safety apparatus of claim 1 and further comprising:

at least one cable diverter releasably securable to the scaffolding between the front frame assembly and the rear frame assembly.

11. The safety apparatus of claim 10 wherein each cable diverter is free floating cable guides mounted around needle bearings allowing cable grabs to pass by without hanging up.

12. A safety apparatus for releasably securing persons wearing a body harness to scaffolding, the scaffolding having a plurality of horizontal and vertical bars, the safety apparatus comprising:

a front frame assembly releasably securable between a first two adjacent bars of the scaffolding;

a rear frame assembly releasably securable between a second two adjacent bars of the scaffolding, the rear frame assembly spaced from the front frame assembly, the rear frame assembly having a first end and a second end with a cable suspension section at the first end and a clamp assembly at the second end;

a cable retractably connected between the front frame assembly and the rear frame assembly, the body harness releasably connectable to the cable;

a first elongated tube extending from the first end of the rear frame assembly;

a second elongated tube extending from the second end of the rear frame assembly with the first elongated tube receivable within the second elongated tube;

a plurality of aligned apertures in the first elongated tube and the second elongated tube; and at least one pin releasably securable within the aligned apertures.

13. A safety apparatus for releasably securing persons wearing a body harness to scaffolding, the scaffolding having a plurality of horizontal and vertical bars, the safety apparatus comprising:

a front frame assembly releasably securable between a first two adjacent bars of the scaffolding;

a rear frame assembly releasably securable between a second two adjacent bars of the scaffolding, the rear frame assembly spaced from the front frame assembly;

a cable retractably connected between the front frame assembly and the rear frame assembly, the body harness releasably connectable to the cable; and a cable tensioning device at the first end of the front frame assembly;

wherein the cable tensioning device has a housing and a slot with a clear replaceable cover;

wherein the housing is a hardened stainless steel reinforcement tube housing a semi-threaded steel shaft; and wherein the threaded shaft is encompassed by a number of tensile springs varying in the amount of tension.

14. The safety apparatus of claim 13 wherein the springs are positioned along the length of the shaft in a sequential manner defined by the tensile strength of each spring; the spring with the highest tensile strength being positioned adjacent to an attachment eyelet, the spring with the least amount of tensile strength being positioned at the opposite end.

15. A safety apparatus for releasably securing persons wearing a body harness to scaffolding, the scaffolding having a plurality of horizontal and vertical bars, the safety apparatus comprising:

a front frame assembly releasably securable between a first two adjacent bars of the scaffolding;

a rear frame assembly releasably securable between a second two adjacent bars of the scaffolding, the rear frame assembly spaced from the front frame assembly;

a cable retractably connected between the front frame assembly and the rear frame assembly, the body harness releasably connectable to the cable; and a cable case secured to the rear frame assembly;

wherein the cable case is a two piece design said cable case comprising bearing with all bearings being positioned inside a protective housing; and wherein the cable case has apertures for receiving the cable allowing the cable to spindle and exit out either side.

16. A safety apparatus for releasably securing persons wearing a body harness to scaffolding, the scaffolding having a plurality of horizontal and vertical bars, the safety apparatus comprising:

a front frame assembly releasably securable between a first two adjacent bars of the scaffolding;

a rear frame assembly releasably securable between a second two adjacent bars of the scaffolding, the rear frame assembly spaced from the front frame assembly;

a cable retractably connected between the front frame assembly and the rear frame assembly, the body harness releasably connectable to the cable; and at least one cable diverter releasably securable to the scaffolding between the front frame assembly and the rear frame assembly wherein each cable diverter is free floating cable guides mounted around needle bearings allowing cable grabs to pass by without hanging up.

* * * * *